US008210970B1

(12) United States Patent
Sanford

(10) Patent No.: US 8,210,970 B1
(45) **Date of Patent: *Jul. 3, 2012**

(54) EXPANDABLE ARROW BROADHEAD WITH ROTATING CUTTING BLADES AND SHAFT

(75) Inventor: Chris G. Sanford, Billings, MT (US)

(73) Assignee: Bear Archery, Inc., Evansville, IN (US)

( * ) Notice: Subject to any disclaimer, the term of this patent is extended or adjusted under 35 U.S.C. 154(b) by 1432 days.

This patent is subject to a terminal disclaimer.

(21) Appl. No.: 11/809,652

(22) Filed: Jun. 1, 2007

Related U.S. Application Data

(63) Continuation-in-part of application No. 11/410,771, filed on Apr. 24, 2006, now Pat. No. 7,226,375.

(51) Int. Cl.
*F42B 6/08* (2006.01)

(52) U.S. Cl. ..... 473/583

(58) Field of Classification Search ..... 473/578, 473/583, 584

See application file for complete search history.

(56) References Cited

U.S. PATENT DOCUMENTS

| | | | | |
|---|---|---|---|---|
| 2,859,970 | A | 11/1958 | Doonan | |
| 4,099,720 | A | 7/1978 | Zeren | |
| 4,671,517 | A * | 6/1987 | Winters | 473/583 |
| 5,100,143 | A | 3/1992 | Puckett | |
| 5,322,297 | A | 6/1994 | Smith | |
| 5,496,042 | A * | 3/1996 | Craft et al. | 473/583 |
| 5,941,784 | A | 8/1999 | Mizek | |
| 6,200,237 | B1 | 3/2001 | Barrie | |
| 6,258,000 | B1 | 7/2001 | Liechty, II | |
| 6,270,435 | B1 | 8/2001 | Sodaro | |
| 6,517,454 | B2 | 2/2003 | Barrie et al. | |
| 6,626,776 | B2 | 9/2003 | Barrie et al. | |
| 6,669,586 | B2 | 12/2003 | Barrie et al. | |
| 6,935,976 | B1 | 8/2005 | Grace et al. | |
| 7,226,375 | B1 * | 6/2007 | Sanford | 473/583 |
| 2006/0084535 | A1 * | 4/2006 | Kuhn | 473/583 |

* cited by examiner

*Primary Examiner* — John Ricci

(74) *Attorney, Agent, or Firm* — Woodard, Emhardt, Moriarty, McNett & Henry LLP

(57) ABSTRACT

An expandable arrow broadhead used for releasable attachment to one end of a hollow arrow shaft. The broadhead includes a rotating, sliding shaft with a spirally wound, scalloped grooved, pointed tip and tip base having two or more of cutting blades mounted thereon. A portion of the sliding shaft is slidably received inside a hollow collar attached to a sliding shaft housing. The sliding shaft housing is attached to an arrow shaft insert adapted for receipt inside one end of the arrow shaft. In a retracted position, the blades are disposed next to and parallel to the length of the sliding shaft. When the pointed tip engages a target, the sliding shaft moves inwardly and rearwardly sliding inside the collar. As the sliding shaft moves rearwardly, a beveled cam surface of the blades engages a portion of the collar, which moves the blades outwardly in an extended and locked position.

25 Claims, 3 Drawing Sheets

EXPANDABLE ARROW BROADHEAD WITH ROTATING CUTTING BLADES AND SHAFT

This application is a Continuation-In-Part patent application of an application filed on Apr. 24, 2006, Ser. No. 11/410,771 now U.S. Pat. No. 7,226,375, by the subject inventor and having a title of "EXPANDABLE ARROW BROADHEAD FOR ATTACHMENT TO ONE END OF AN ARROW SHAFT". The inventor claims the benefit of the earlier filed application.

BACKGROUND OF THE INVENTION (a) Field of the Invention

This invention relates broadly to an expandable arrow broadhead and more particularly, but not by way of limitation, to an arrow broadhead having a rotating, sliding shaft received through a hollow collar mounted on a sliding shaft housing. An end of the hollow collar is used for extending outwardly at least two cutting blades, and preferably three cutting blades, upon impact on a target. During arrow flight, the cutting blades are held in a retracted position using a coil spring for biasing the sliding shaft in the sliding shaft housing.

(b) Discussion of Prior Art

Heretofore, there have been a number of arrow broadheads having blades that extend outwardly when contacting a surface of a target. U.S. Pat. No. 6,935,976 to Grace, Jr. et al., discloses a mechanical broadhead having blades, mounted in longitudinal channels in a ferrule, that slide outwardly on a camming surface formed in an inward edge of each blade. U.S. Pat. No. 6,270,435 to Sodaro illustrates an arrowhead having spring loaded blades that expand outwardly upon contact with a target. U.S. Pat. Nos. 6,910,979, 6,626,776 and 6,517,454 to Barrie et al. disclose blades having longitudinal grooves in the blades and a camming member for extending the blades outwardly upon target impact. U.S. Pat. Nos. 6,669,586 and 6,200,237 to Barrie disclose blades mounted on a sliding body mounted on a length of the broadhead. As the sliding body moves rearwardly upon target impact, the blades engage a camming surface and are moved outwardly in an extended position.

None of the above mentioned prior art broadhead patents particularly disclose or teach the structure and function of an arrow broadhead having a rotating, sliding shaft with a pointed, scalloped grooved tip and cutting blades attached. The sliding shaft is designed to move rearwardly upon target impact with the blades expanding outwardly upon engaging a threaded collar attached to a sliding shaft housing. The sliding shaft housing mounted in one end of a hollow arrow shaft.

SUMMARY OF THE INVENTION

In view of the foregoing, it is a primary objective of the subject invention to provide an aerodynamic, arrow broadhead that maintains cutting blades in a retracted folded, compact profile, position, typically having an in-flight diameter of 0.55 inches, and next to a sliding shaft housing for little or no deflection at target contact. The arrow broadhead flight is similar to an arrow with field tip flight. This feature eliminates the need to adjust sight pins, which is a common complaint of mechanical and fixed broadheads, especially with bows that shoot over 300 fps. The cutting blades are held in the retracted position using a coil spring. The coil spring is mounted inside a collar bore hole. This feature eliminates the need of having a stretchable band received around a portion of the cutting blades during allow flight.

Another primary objective of the invention is using the broadhead's forward inertia and using a rotating, sliding shall moving rearward in a hollow collar mounted on a sliding shaft housing, to almost instantaneously upon target contact to move the cutting blades into a fully open and locked position. The forward inertia of the arrow broadhead, the rotation of the cutting blades and the rotation of a spirally wound, scalloped-grooved pointed tip provide for an ultimate penetration of the target. This feature results in larger entry and exit holes, better blood trails and higher game recovery.

Yet another object of the broadhead is a unique streamlined, spirally wound, scalloped grooved pointed tip, which rotates during flight and upon target. This feature during flight reduces planning and wind resistance with improved flight accuracy. This feature during target contact provides a drill-like motion for penetration through skin, bone and muscle and then into an animal's vital organs.

Still another object of the invention is the subject broadhead gives a hunter a distinct advantage during an angled shot, which will enter the target without deflection. This feature means the arrow with broadhead will enter the target exactly where it's aimed, thus resulting in better shot placement, better penetration and more target damage. Most mechanical broadheads can deflect on an angled shot, thereby causing poor penetration and missed vital organs.

The subject arrow broadhead includes a sliding shaft with a spirally wound, scalloped-grooved, pointed tip disposed in a front portion of the shaft. The pointed tip is tapered rearwardly and outwardly forming a tip base. The tip base includes cutting blade grooves formed therein and parallel to a length of the sliding shaft. The cutting blade grooves are used for receiving a pivot end of two or more of cutting blades. The pivot end of the cutting blades is pinned to sides of the grooves. Each of the blades includes an outer cutting edge and an inner edge. The inner edge of the blades includes a beveled cam surface disposed next to a portion of the length of the sliding shaft. The cam surface includes an inverted "V" shaped locking notch therein. A portion of the sliding shaft is slidably received inside a hollow collar. The collar is attached to a sliding shaft housing. Optionally, the collar can be attached inside one end of a hollow arrow shaft. In a retracted position, the blades are disposed next to and parallel to the length of the sliding shaft. When the pointed tip engages a target upon impact, the sliding shaft moves rearward sliding inside the threaded collar. As the sliding shaft moves rearward, the beveled cam surface engages a portion of the threaded collar and moves the blades outwardly into an extended position. At this time, the locking notch is received around a portion of the threaded collar for holding the cutting blades in an extended, fixed position during the engagement of the target.

These and other objects of the present invention will become apparent to those familiar with the use of arrow broadheads for hunting when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it's practical application and in which.

DETAILED DESCRIPTION OF THE PREFERRED EMBODIMENTS

Figure 1:
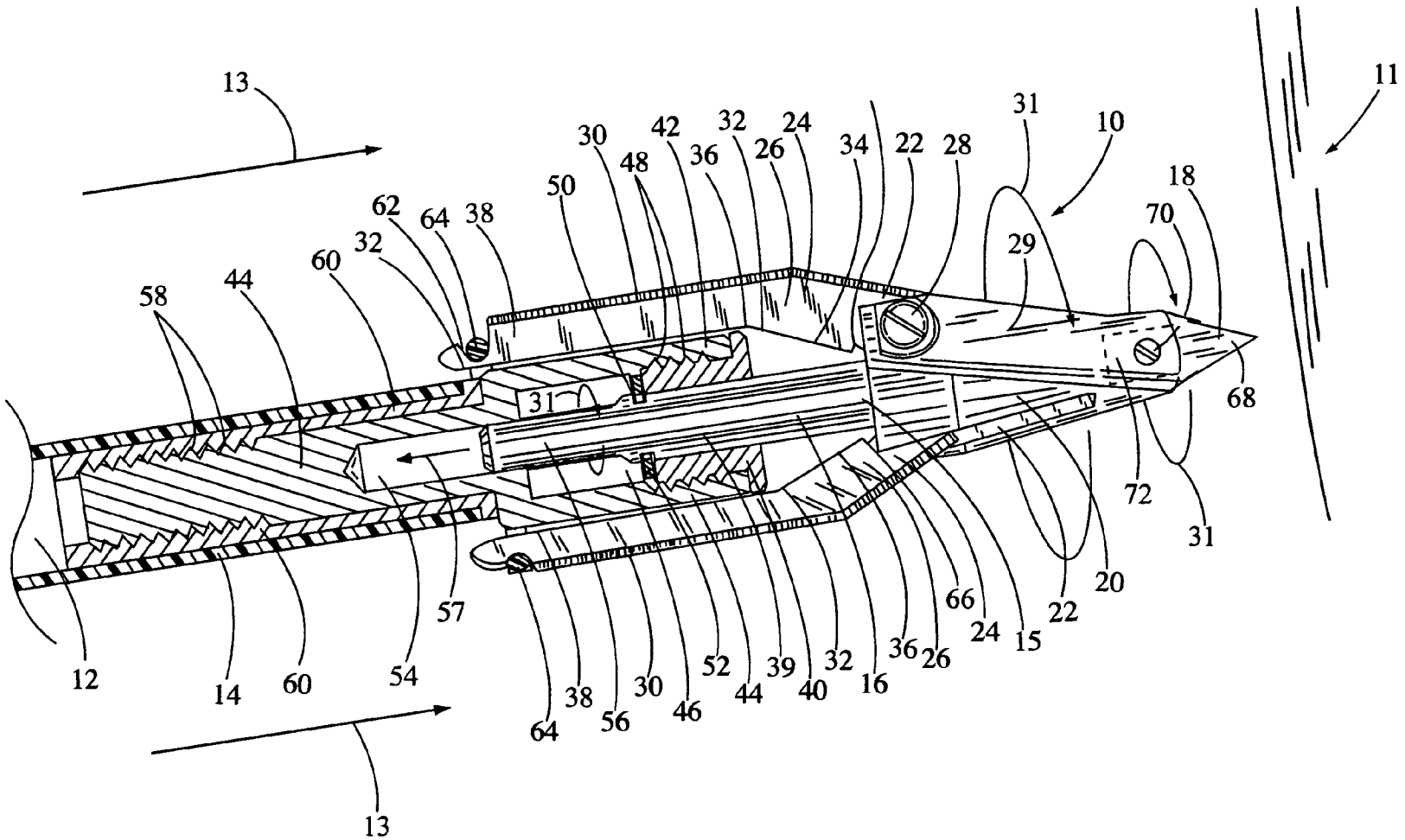
FIG. 1 is a perspective view of the subject arrow broadhead rotating in flight and prior to target contact. The cutting blades are shown in a retracted position next to a side of a sliding shaft housing. The sliding shaft housing with attached threaded, hollow collar is shown in cross-section. The sliding shaft housing is used for receiving a portion of a rotating, sliding shaft attached to a pointed tip. A threaded lower end of the sliding shaft housing is attached to an arrow shaft insert in a hollow arrow shaft.

In FIG. 1, a perspective view of the subject aerodynamic arrow broadhead is shown in flight and having general reference numeral 10. In this drawing, the broadhead 10 is heading toward a target, having a general reference numeral 11. The flight of the broadhead 10 is indicated by arrows 13. The arrow broadhead 10 is adapted from mounting to an open end 12 of a hollow arrow shaft 14. A portion of the arrow shaft 14 is shown in cross section.

The arrow broadhead 10 includes a rotating, sliding shaft 16 with a pointed tip 18 disposed in a front portion 15 of the shaft 16. The sliding shaft 16 has an annular cross section, but it could have other geometric cross sections if desired for receipt and sliding inside the broadhead 10. The pointed tip 18 is tapered rearwardly and outwardly forming a tip base 20. It should be mentioned that while the shaft 16, the pointed tip 18 and the tip base 20 can be a one-piece unit, the front portion 15 of the shaft 16 can also be threaded, press fit, pinned or glued into an opening in the bottom of the tip base 20. This feature of threading, press fitting or pining the front portion 15 of the shaft in an opening in the bottom of the tip base 20 is not shown in the drawings.

Figure 6:
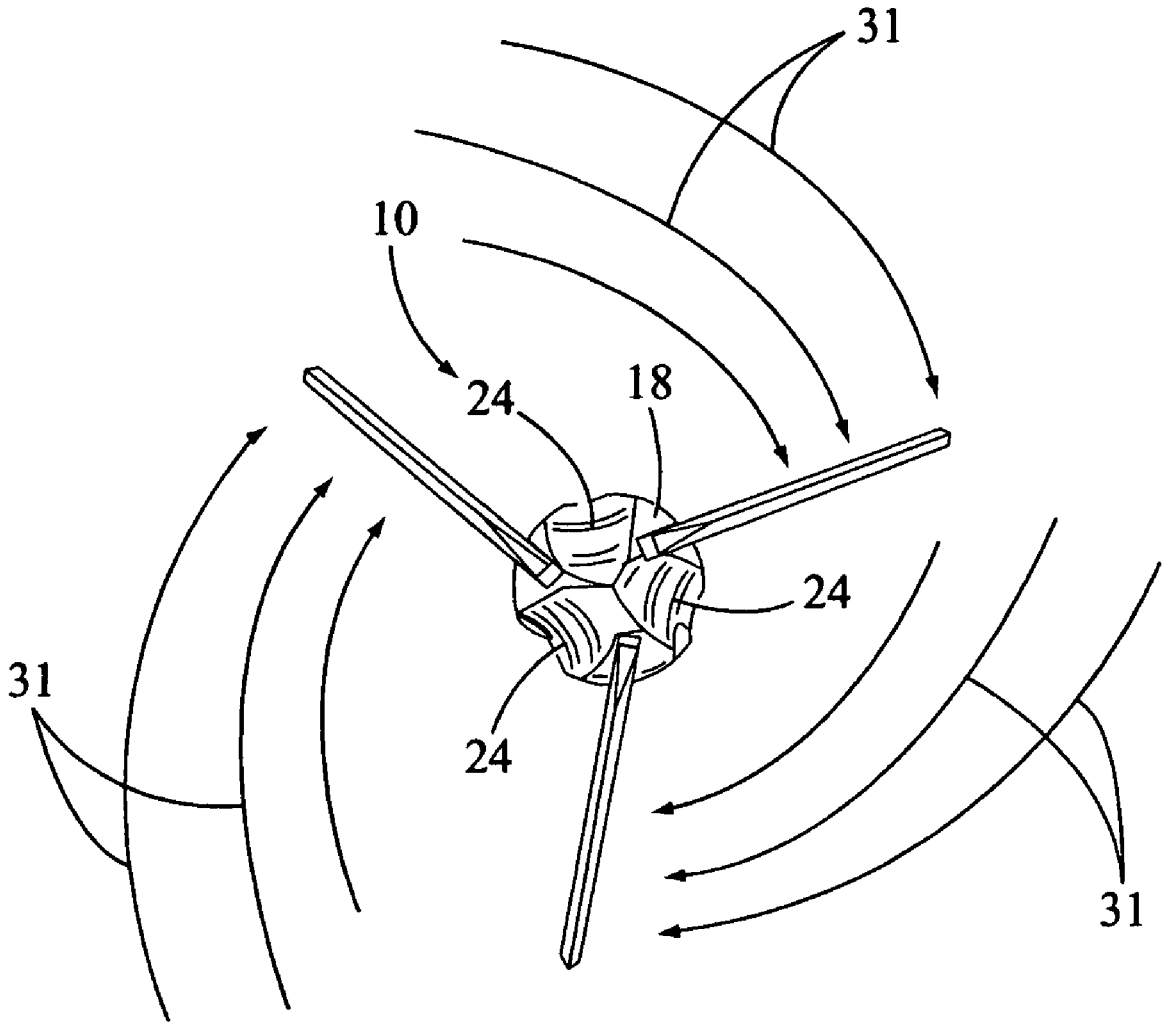
FIG. 6 is a front view of the arrow broadhead illustrating the spirally wound, scalloped grooves in the pointed tip with three cutting blades in a fully extended and locked position. The pointed tip providing a drill-like motion as it moves through the target.

The tip base 20 includes cutting blade grooves 22 formed therein and parallel to a length of the sliding shaft 16. The cutting blade grooves 22 are used for receiving a pivot end 24 of two or more of cutting blades 26 equally spaced around a circumference of the tip base 20. In this drawing, two of the cutting blades 26 are shown. In FIG. 6, three of the cutting blades 26 are shown and equally spaced around the tip base 20. The pivot end 24 of the cutting blades 26 is attached to the sides of the grooves 22 using pivot pins 28.

While one or two cutting blades 26 might be used on the broadhead 10, three cutting blades 26 are preferred. Also, up to five cutting blades could be mounted equally well on the broadhead.

It should be mentioned that a key feature of the broadhead 10 is the pointed tip 18 with spirally wound, scalloped grooves 29 therein. The scalloped grooves 29, during flight and during target contact, provide for rotating the pointed tip 18, the tip housing 20 with attached cutting blades 26 and the sliding shaft 16, as indicated by arrows 31. As mentioned above, this feature during arrow flight reduces planning and wind resistance with improved flight accuracy.

Each of the cutting blades 26 include an outer cutting edge 30 and an inner edge 32. The inner edge 32 of the blades 26 is disposed next to a portion of a length of the sliding shaft 16. Also, the inner edge 32 of the blades 26 is characterized by having a forward portion 34 with a beveled cam surface 36 and a rearward portion 38. In this example, the rearward portion 38 of the blades is shown parallel to the length of the sliding shaft 16.

While the beveled cam surface 36 is shown in the forward portion of the blades 26, it should be kept in mind various cam surfaces can be designed on the inner edge 32 of the blades 26. Also, the entire length of the inner edge 32 can be sloped slightly upward from front to the rear of the blade and provide a cam surface for expanding the blades at target contact. This feature is not shown in the drawings.

A middle portion 39 of the sliding shaft 16 is slidably received inside and through a hollow collar 40. The exterior of the collar 40 is threaded into a top portion 42 of a sliding shaft housing 44. The hollow collar 40 acts as a cylinder for allowing the shaft 16 to both slide and rotate therein during arrow flight and during target contact. Also, the arrow shaft 14, attached to the sliding shaft housing 44, is free to rotate around the sliding shaft 16.

In another embodiment of the broadhead 10, the cutting blades 26 can be folded into elongated, parallel grooves along a length of the sliding shaft housing 40 when in a retracted position. This feature will provide a smaller and more streamlined profile of the broadhead 10 during arrow flight. Part of each blade or all of each blade could be received in the parallel grooves depending on the size of the sliding shaft housing. The parallel grooves are not shown in the drawings. Obviously, if the elongated, parallel grooves were used in the sliding shaft housing 40, the blades 26 could not rotate during arrow flight, but they would be free to rotate as they expand outwardly into an extended position upon target contact.

The sliding shaft housing 44 includes a collar bore hole 46 with an threaded upper end 48. The threaded upper end 48 of the collar bore hole 46 is used for threading the hollow collar 40 thereon. Also, the hollow collar 40 can be press fitted in the collar bore hole 46. Further, the hollow collar 40 can be threaded or press fitted around an outside of a top portion of the sliding shaft housing 44.

In the lower end of the middle portion 39 of the shaft 16 is an annular groove 50 for receiving a ring keeper 52. The ring keeper 52 prevents the sliding shaft 16 from being removed from inside the threaded hollow collar 40. While the ring keeper 52 is shown in the drawings, various types of shaft retaining devices such as a treaded nut, key, pin or a widened area in the shaft 16 can be used equally well.

Also, the sliding shaft housing 44 includes a smaller, sliding shaft lower bore hole 54 for receiving a lower end portion 56 of the sliding shaft 16, as indicated by arrow 57. While the lower bore hole 54 is shown to add strength to the sliding shaft housing 44 for receiving the sliding shaft 16, the shaft 16 could be shortened and slide only inside the collar bore hole 46, thus eliminating the need of the lower bore hole 54.

A threaded lower end 58 of the sliding shaft housing 44 is used for attachment to an arrow shaft insert 60 in the hollow arrow shaft 14. The lower end 58 can also be without threads and attached to the arrow shaft insert 60 in a press fit. Typical, hunting arrows include the arrow shaft insert 60, therefore, the arrow Broadhead 10 can be easily attached to different types of arrows by merely threading the sliding shaft housing 44 into the arrow shaft insert 60 as shown.

The outer cutting edge 30 of the blades 26 includes an outer notch 62 for receiving a portion of a stretchable band 64 or like blade retaining device for holding the blades 26 in a folded, retracted position, as shown in this drawing. While the notch 62 is shown in the outer cutting edge 30, it can also be placed in the rear end of each cutting blade 26 or in a notch in the rear of the inner edge 32 and work equally well in holding the blades in a retracted position. Also, the band 64 helps prevent the sliding shaft 16 from sliding rearward and inward in the collar 40 during the flight of the arrow and prematurely extending the blades 26 outwardly in an extended position as shown. The band 64 is shown in cross section and can be made of rubber or flexible plastic. Also, the band can be a metal ring or metal washer.

Also in this drawing, the cutting blades 26 are shown with an inverted "V" shaped locking notch 66 formed in the inner edge 32 of the beveled cam surface 36. The locking notch 66 is disposed in the forward portion 34 of the blade. The feature of the locking notch 66 is important in that when the cam surface 36 slides against a portion of the hollow collar 40 and when the cutting blade 26 is in an extended position, the locking notch 66 drops into a locked position on a side of the hollow collar 40 thus holding the blades in the extended position.

Further shown in this drawing and as an option, the pointed tip 18 can include a removable, razor sharp, replaceable tip 68. A dulled or damaged tip 68 can be removed and replaced by removing a locking pin 70. The locking pin 70 is threaded into the tip base 20 and through a lower end portion 72 of the tip 68. The lower end portion 72 is received in a groove in the front of the tip base 20.

Figure 2:
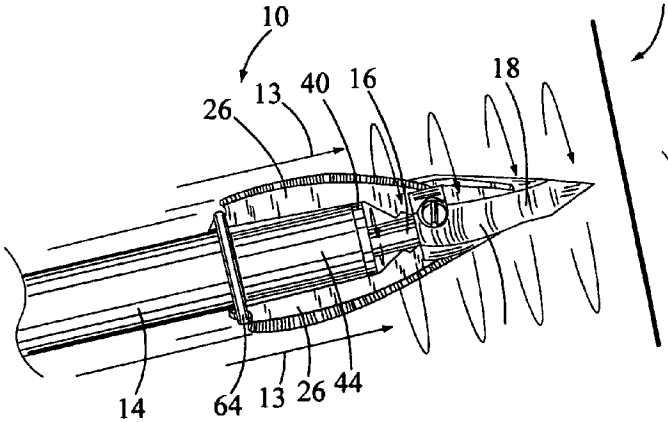
FIG. 2 is a side view of the arrow broadhead with the cutting blades in a retracted position and a portion of the arrow shaft. The broadhead is shown in flight and prior to contact.

In FIG. 2, a side view of the arrow broadhead 10 is shown with the cutting blades 26 in a retracted position and in flight prior to target contact. In this view, the cutting blades are shown held next to the sliding shaft housing 44 using the flexible band 64. Also during flight, the pointed tip 18, cutting blades 26 and sliding shaft 16 are free to rotate as indicated by arrows 31. The in flight diameter of the broadhead 10 with retracted cutting blades 26 is typically 0.55 inches. In this drawing and in FIGS. 3-6, the broadhead 10 is shown with a solid pointed tip 18 and without the optional replaceable tip 68.

Figure 3:
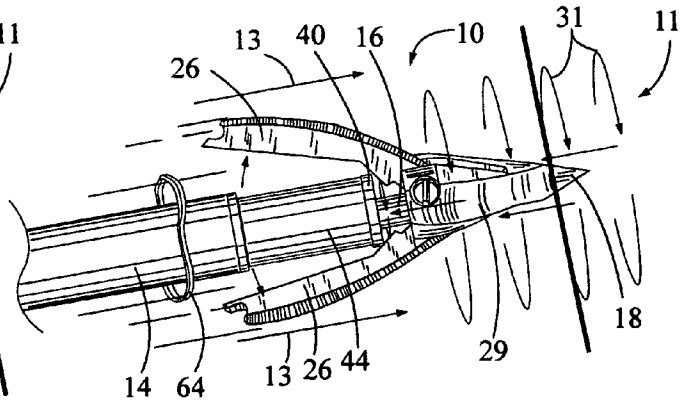
FIG. 3 is another side view of the arrow broadhead with the pointed tip contacting and entering the target. Also, the cutting blades are shown beginning to extend outwardly from the sliding shaft housing with a stretchable band, used to hold the cutting blades in a retracted position, rolled backward onto a portion of the arrow shaft.

In FIG. 3, another side view of the arrow broadhead 10 is shown with the pointed tip 18 contacting and entering the target 11. Also, the cutting blades 26 are shown beginning to extend outwardly from the sliding shaft housing 44 with the flexible band 64 breaking free from the end of the cutting blades 26. At the point of contact, the rotating and sliding shaft 16 begins to move rearwardly through the hollow collar 40 into the sliding shaft lower bore hole 54, as shown in FIG. 1.

Figure 4:
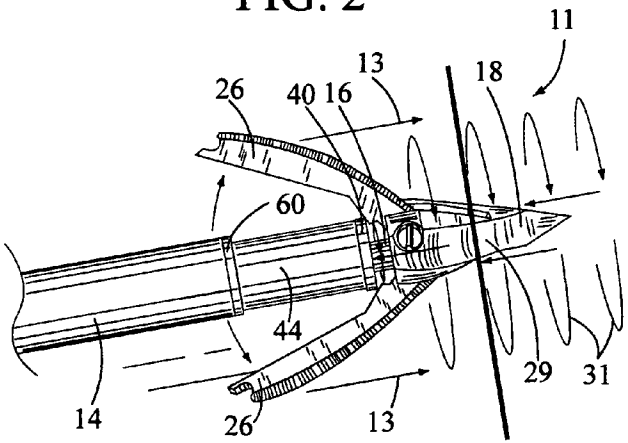
FIG. 4 is still another side view of the arrow broadhead with the cutting blades continuing to extend outwardly and the pointed tip rotating into the target.

In FIG. 4, still another side view of the arrow broadhead 10 is shown with the cutting blades 26 continuing to extend outwardly with the pointed tip 18 rotating into the target 11 with a drill-like motion for cutting through skin, muscle and into vital organs of an animal.

Figure 5:
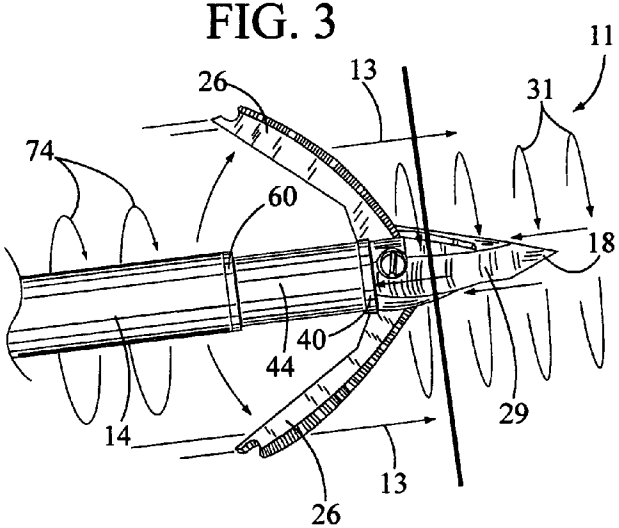
FIG. 5 is a further side view of the arrow broadhead with the cutting blades fully extended and in a locked position and advancing through the target.

In FIG. 5, a further side view of the arrow broadhead 10 is shown with the cutting blades 26 fully extended and in a locked position using the (inverted "V" shaped locking notch 66 in each blade and engaging a side of the hollow collar 40. In the fully extended, locked position, the diameter of the broadhead 10 is typically 1.5 inches. Also, the cutting blades 26 can be adjusted to pivot on the sliding shaft housing 44 to extend in a range of 0.75 to 5.0 inches for hung various sizes and types of targets. Further, the blades 26 can be designed to rotate from a retracted position next to the side of the sliding shaft housing 44 up to 180 degrees next to the pointed tip 18, when extracting the broadhead 10 from the target 11.

It should be mentioned that should the pointed tip 18 contact a bone rib and be deflected, the hollow arrow shaft 14, arrow shaft insert 60 and sliding shaft housing 44 are then free to rotate around the shaft 16, as indicated by arrows 74, and thus maintain the broadhead's forward inertia moving through the target 11. The is an added feature to the broadhead 10 through the use of the sliding shaft 16 in the sliding shaft housing 44.

In FIG. 6, a front view of the arrow broadhead 10 is illustrated with the spirally wound, scalloped grooves 24 spaced around the pointed tip 18 with three cutting blades 26 equally spaced therearound. The blades are shown in a fully extended and locked position.

While the invention has been particularly shown, described and illustrated in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which an exclusive privilege and property right are claimed are defined as follows:

1. An arrow broadhead adapted for attaching to an open end of a hollow arrow shaft, the broadhead adapted for moving from a retracted position during arrow flight to an extended position when contacting a target, the broadhead comprising:

a rotating, sliding shaft having a spirally wound, scalloped grooved pointed tip for helping rotate said pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface;

a hollow collar for receiving a portion of said rotating, sliding shaft therethrough; and a sliding shaft housing having a bore hole therein and a lower end, said hollow collar attached to a front portion of said sliding shaft housing, said sliding shaft housing receiving said rotating, sliding shaft therein, a lower end portion of said sliding shaft received in said bore hole, the lower end of said sliding shaft housing adapted for receipt inside the open end of the hollow arrow shaft;

whereby, when said pointed tip contacts a target, said sliding shaft moves inwardly into said bore hole and the beveled cam surface of said blades contacts a side of said sliding shaft housing and moves said blades outwardly from a folded, retracted position into an extended position.

2. The broadhead as described in claim 1, wherein said hollow collar is threaded inside said bore hole in said sliding shaft housing.

3. The broadhead as described in claim 1, wherein said hollow collar is received in a press fit inside said bore hole in said sliding shaft housing.

4. The broadhead as described in claim 1, wherein said hollow collar is threaded around an outside of an upper end of said sliding shaft housing and next to said bore hole.

5. The broadhead as described in claim 1 wherein said hollow collar is received in a press fit around an outside of an upper end of said shaft housing next to said bore hole.

6. The broadhead as described in claim 1 wherein said pointed tip with tip base is formed into a one-piece unit with said sliding shaft.

7. The broadhead as described in claim 1 wherein a front portion of said sliding shaft is threaded into an opening in the tip base of said pointed tip.

8. The broadhead as described in claim 1 wherein a front portion of said sliding shaft is press fitted into an opening in the tip base of said pointed tip.

9. The broadhead as described in claim 1 wherein a front portion of said sliding shaft is pinned inside an opening in the tip base of said pointed tip.

10. The broadhead as described in claim 1 further including three cutting blades equally spaced around a circumference of said tip base and pinned inside grooves in the side of said tip base.

11. The broadhead as described in claim 1 wherein the cutting blades are received in elongated, parallel grooves along a length of and in the side of said sliding shaft housing for providing a smaller and more streamlined profile when in a refracted position during arrow flight.

12. The broadhead as described in claim 1 further including a blade retaining band received in a notch in said blades, said blade retaining band for holding said blades in a folded, retracted position during flight.

13. The broadhead as described in claim 12 wherein said blade retaining band is a flexible plastic band, a rubber band and a metal ring or metal washer.

14. The broadhead as described in claim 12 wherein said notch in said blades is in a rear portion of said cutting blades.

15. The broadhead as described in claim 1 wherein said pointed tip includes a replaceable tip, a lower end portion of said replaceable tip received in a groove in a front of said tip base and pinned thereto.

16. The broadhead as described in claim 1 wherein said beveled cam surface extends an entire length of the inner edge of said cutting blades.

17. An arrow broadhead adapted for attaching to an open end of a hollow arrow shaft, the broadhead adapted for moving from a retracted position during arrow flight to an extended position when contacting a target, the broadhead comprising:

a rotating, sliding shaft having a spirally wound, scalloped grooved pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface, also the inner edge of said cutting blades having a locking notch therein;

a hollow collar for receiving a portion of said rotating, sliding shaft therethrough; and a sliding shaft housing having a bore hole therein and a lower end, said hollow collar attached to a front portion of said sliding shaft housing, a lower end portion of said rotating, sliding shaft received in said bore hole, the lower end of said sliding shaft housing adapted for receipt inside the open end of the hollow arrow shaft;

whereby, when said pointed tip contacts a target, said sliding shaft moves inwardly through said hollow collar and into said bore hole and the beveled cam surface of said blades contacts a portion of a side of said hollow collar and moves said blades outwardly from a folded, retracted position into an extended position and in an extended position said locking notch received against a portion of said hollow collar for holding said blades in an extended position.

18. The broadhead as described in claim 17 wherein said pointed tip includes a replaceable tip, a lower end portion of said replaceable tip received in a groove in a front of said tip base and pinned thereto.

19. The broadhead as described in claim 17 wherein a portion of said sliding shaft includes an annular groove therein for receiving a ring keeper, said ring keeper preventing said sliding shaft from being removed from said hollow collar.

20. The broadhead as described in claim 17 wherein a portion of said sliding shaft includes a treaded nut, key, pin or a widened area for preventing said sliding shaft from being removed from said hollow collar.

21. An arrow broadhead adapted for attaching to an open end of a hollow arrow shaft, the broadhead also adapted for moving from a folded, retracted position during arrow flight to an extended position when contacting a target, the broadhead comprising:

a rotating, sliding shaft having a spirally wound, scalloped grooved pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface, also the inner edge of said blades includes a locking notch therein; and a hollow collar adapted for receipt inside the open end of the hollow arrow shaft, a lower end portion of said sliding shaft slidably received inside said collar, whereby, when said pointed tip contacts the target, said rotating, sliding shaft moves inwardly through said hollow collar and the beveled cam surface of said blades contacts a portion of a side of said hollow collar, the beveled cam surface moving said blades outwardly from the folded, retracted position next to a length of said shaft into the extended position and said locking notch received against a portion of said hollow collar for holding said cutting blades in an extended position.

22. The broadhead as described in claim 21 further including an arrow shaft insert adapted for receipt in the open end of the arrow shaft, said hollow collar received inside said shaft insert.

23. The broadhead as described in claim 21 further including three cutting blades equally spaced around a circumference of said tip base and pinned thereto.

24. The broadhead as described in claim 21 wherein said pointed tip includes a replaceable tip, a lower end portion of said replaceable tip received in a groove in a front of said tip base and pinned thereto.

25. The broadhead as described in claim 21 further including a blade retaining band received in a notch in a rear portion of said blades, said band for holding said blades in a folded, retracted position during arrow flight.

* * * * *